US006523441B2

(12) United States Patent
Lee

(10) Patent No.: US 6,523,441 B2
(45) Date of Patent: Feb. 25, 2003

(54) SWITCH DEVICE OF SOCKET WRENCH EXTENSION

(76) Inventor: Jack Lee, No. 53, Nan-Shi Keng, Da-Nan Village, May-Shan Hsiang, Chia-Yi Hsien (TW)

( * ) Notice: Subject to any disclaimer, the term of this patent is extended or adjusted under 35 U.S.C. 154(b) by 0 days.

(21) Appl. No.: 09/883,038

(22) Filed: Jun. 18, 2001

(65) Prior Publication Data

US 2002/0189409 A1 Dec. 19, 2002

(51) Int. Cl.[7] ..... B25B 23/16

(52) U.S. Cl. ..... 81/177.85; 403/322.1; 403/322.2; 403/325; 81/177.2

(58) Field of Search ..... 81/177.2, 177.85; 403/321, 322.1, 322.2, 325

(56) References Cited

U.S. PATENT DOCUMENTS 1,864,466 A * 6/1932 Peterson ..... 81/177.85
4,502,365 A * 3/1985 Hacker ..... 81/124.6
4,781,085 A * 11/1988 Fox, III ..... 81/177.1
4,817,476 A * 4/1989 Karge ..... 81/177.2
4,865,485 A * 9/1989 Finnefrock, Sr. ..... 403/17
5,090,275 A * 2/1992 McCann ..... 279/71
5,531,140 A * 7/1996 Chow ..... 403/325
5,566,595 A * 10/1996 Goff ..... 403/325
5,813,296 A * 9/1998 Hoff et al. ..... 81/124.4

* cited by examiner

*Primary Examiner*—James G. Smith
(74) *Attorney, Agent, or Firm*—Charles E. Baxley

(57) ABSTRACT

A switch device of a socket wrench extension includes a connecting shank formed with an axial circular hole receiving a restoring member and a drive rod, and a radial hole receiving a positioning ball. The drive rod has a tapered face and an insertion recess. A drive block is received in a radial oblong slot of the connecting shank, and has an insertion block that,may be inserted into the insertion recess of the drive rod. The drive block has a spring recess receiving a spring and a positioning pin. A control ring mounted on the connecting shank may move the drive block and the drive rod, whereby the positioning ball may be moved along the tapered face to sink into the radial hole, so that the connecting shank can be detached from the socket easily and quickly.

2 Claims, 12 Drawing Sheets

SWITCH DEVICE OF SOCKET WRENCH EXTENSION

BACKGROUND OF THE INVENTION

1. Field of the Invention

The present invention relates to a switch device of a socket wrench extension.

2. Description of the Related Art

A conventional socket wrench extension in accordance with the prior art includes a first end formed with a square fitting head which can be inserted into a socket, and a second end formed with an enlarged head which defines a square fitting recess for receiving a square head of a socket wrench. The square fitting head is provided with a ball so that the socket can be tightly mounted on the square fitting head of the socket wrench extension. However, the user has to exert a large force for detaching the socket from the square fitting head of the socket wrench extension so that the socket cannot be easily and quickly mounted on or detached from the square fitting head of the socket wrench extension rod, thereby greatly causing inconvenience in operation of the socket wrench extension.

SUMMARY OF THE INVENTION

The present invention has arisen to mitigate and/or obviate the disadvantage of the conventional socket wrench extension.

In accordance with a first embodiment of the present invention, there is provided a switch device of a socket wrench extension, comprising:

a connecting shank having a square fitting head whose front end is formed with an axial circular hole for receiving a restoring member and a drive rod therein, a radial hole defined through a surface of the square fitting head for receiving a positioning ball, a front end of the drive rod formed with a step having a tapered face, so that the positioning ball is pushed along the tapered face to expose outward from the radial hole;

wherein, a mediate portion of the drive rod is formed with an insertion recess, a radial oblong slot that aligns with the insertion recess is defined in the connecting shank and is communicated with the axial circular hole, a drive block is received in the radial oblong slot, and has a bottom protruded with an insertion block that may be inserted into the insertion recess of the drive rod, the drive block has a top defining a spring recess for receiving a spring and a positioning pin, a control ring is mounted on the connecting shank, an inner wall of the control ring is formed with a groove, so that when the control ring is mounted on the connecting shank, the control ring may be secured on the positioning pin integrally, a through hole is defined in the groove, and has a diameter slightly smaller than that of the positioning pin, so that the through hole may register the positioning pin during a dismantling process.

In accordance with a second embodiment of the present invention, there is provided a switch device of a socket wrench extension, comprising:

a connecting shank having a square fitting head whose front end is formed with an axial circular hole for receiving a restoring member and a drive rod therein, a radial hole defined through a surface of the square fitting head for receiving a positioning ball, a front end of the drive rod formed with a step having a tapered face, so that the positioning ball is pushed along the tapered face to expose outward from the radial hole;

wherein, a mediate portion of the drive rod is formed with an insertion recess, a radial oblong slot that aligns with the insertion recess is defined in the connecting shank and is communicated with the axial circular hole, a drive knob is received in the radial oblong slot, and has a bottom protruded with an insertion block that may be inserted into the insertion recess of the drive rod, a mediate portion of the drive knob has two sides each defining a snap groove for securing a snap ring whose periphery is formed with a slit which is secured with the snap grooves at the two sides of the drive knob, a positioning hole is defined in the periphery of the snap ring and is radially opposite to the slit, a ball recess that aligns with the positioning hole is defined in a periphery of the connecting shank, for receiving a ball which is secured between the positioning hole and the ball recess, such that the snap ring is secured on the connecting shank.

Further benefits and advantages of the present invention will become apparent after a careful reading of the detailed description with appropriate reference to the accompanying drawings.

DETAILED DESCRIPTION OF THE INVENTION

Figure 1:
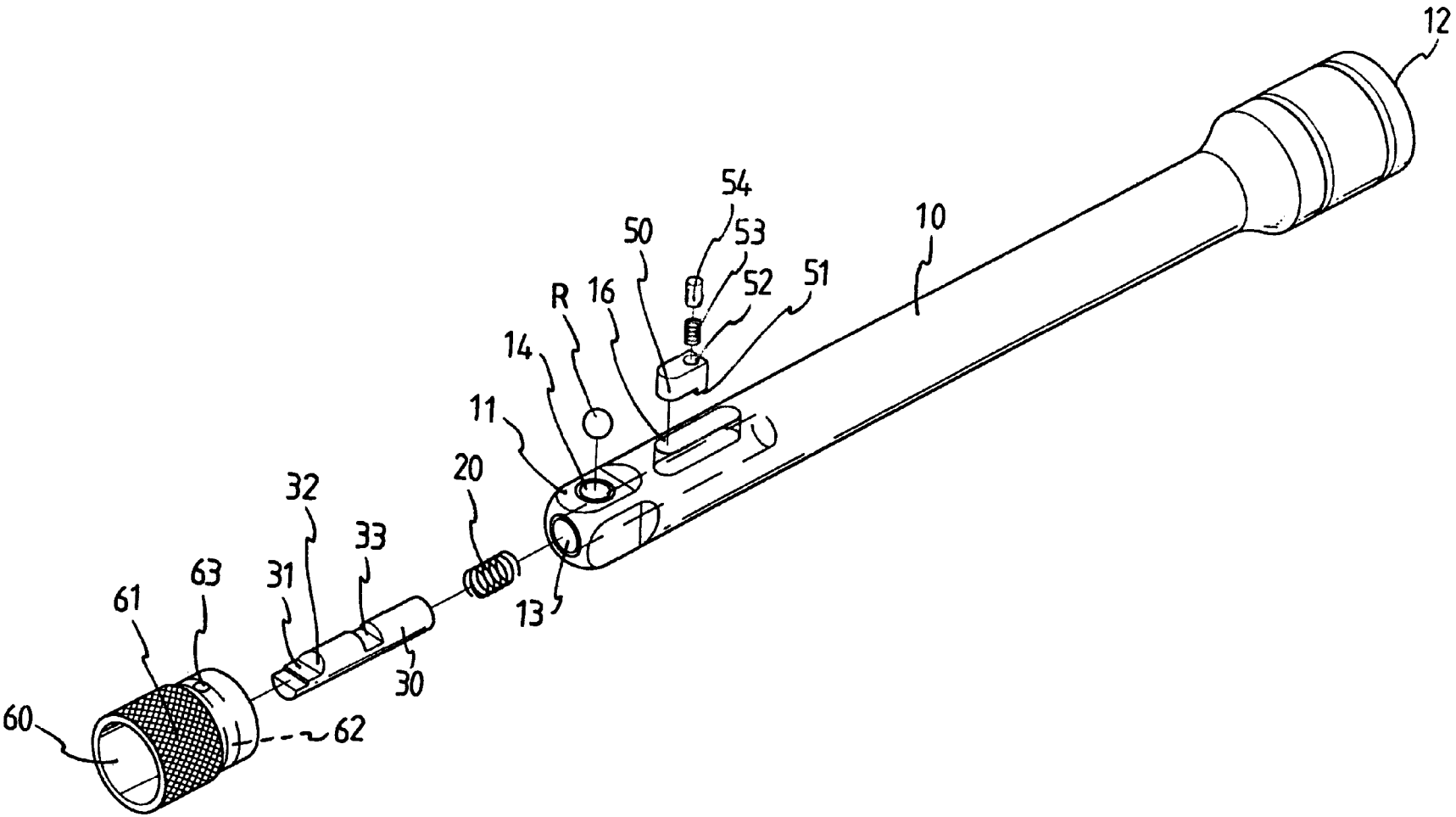
FIG. 1 is an exploded perspective view of a switch device of a socket wrench extension in accordance with a first embodiment of the present invention.
Figure 1A:
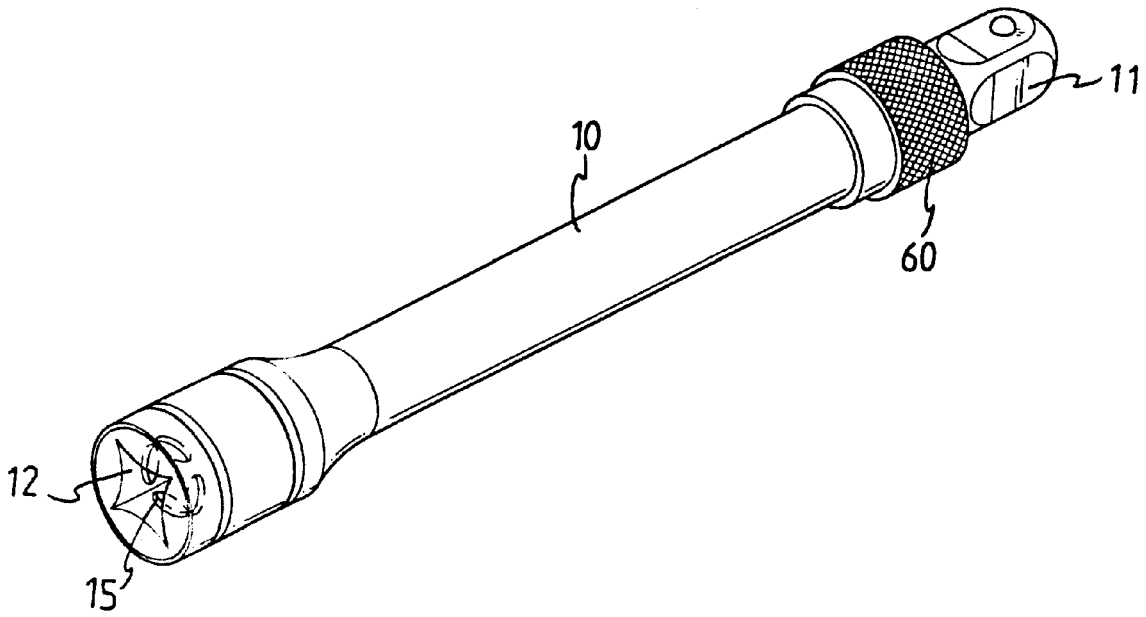
FIG. 1A is a perspective view of the switch device of the socket wrench extension in accordance with the first embodiment of the present invention.
Figure 1B:
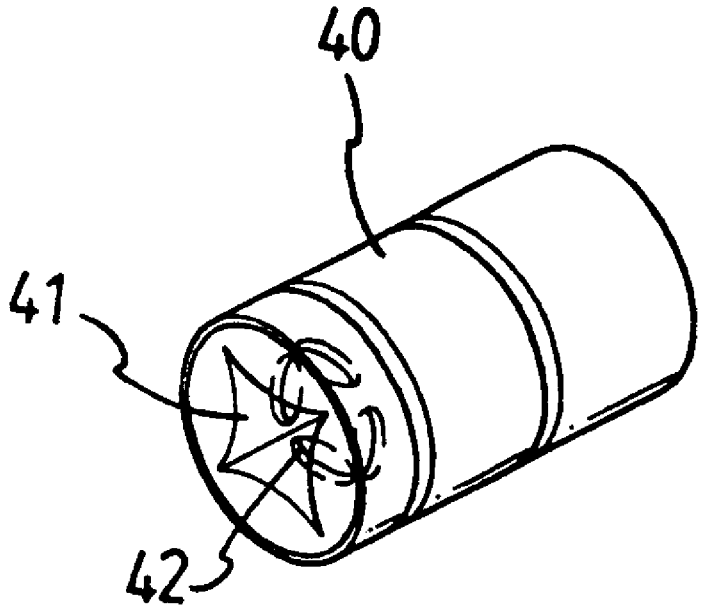
FIG. 1B is a perspective view of a socket usable with the socket wrench extension in accordance with the first embodiment of the present invention.
Figure 2:
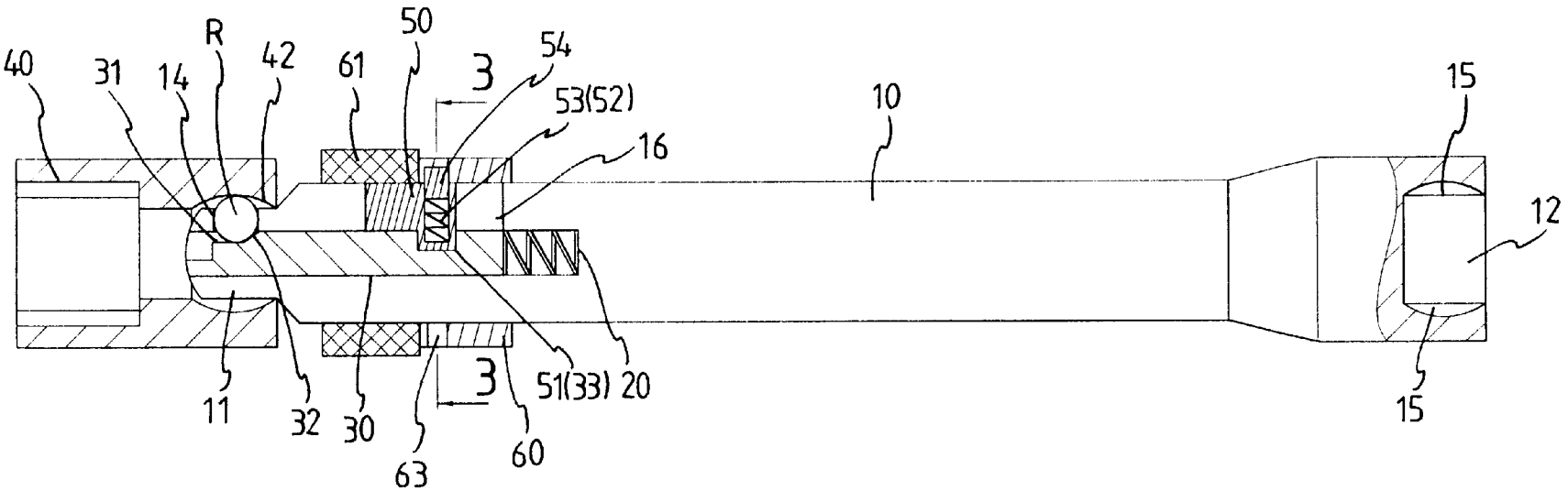
FIG. 2 is a front plan cross-sectional assembly view of the switch device of a socket wrench extension as shown in FIG. 1.
Figure 3:
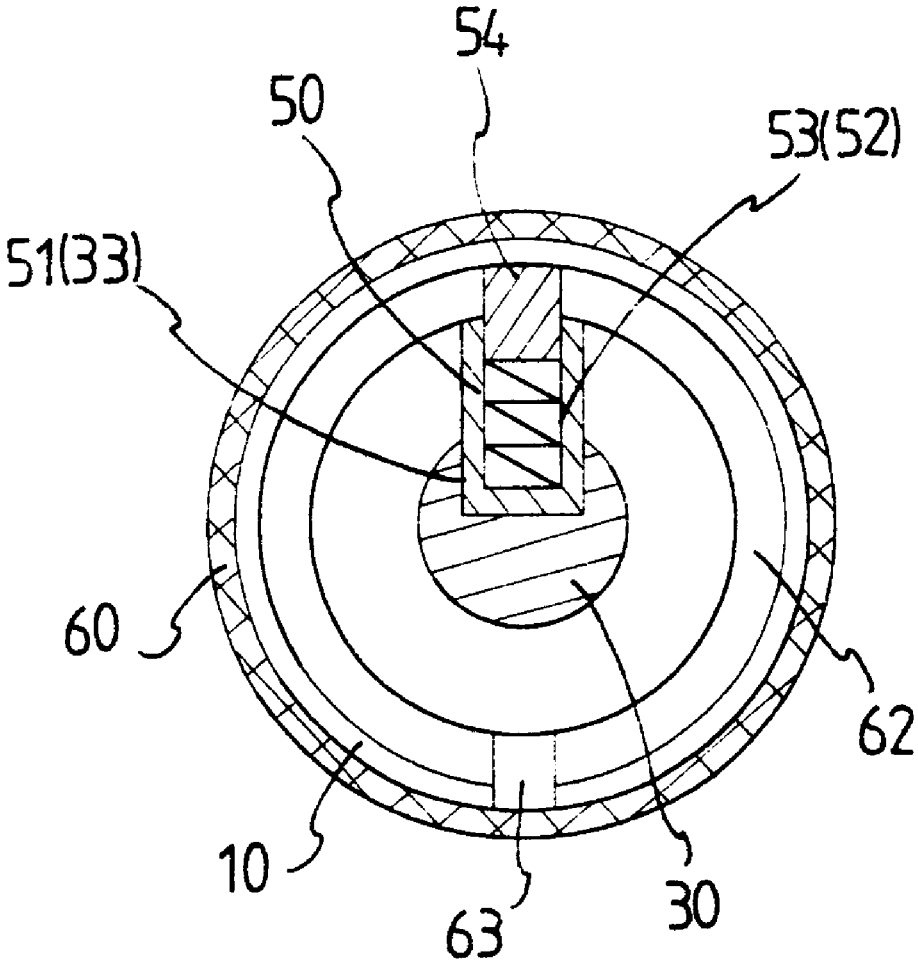
FIG. 3 is a side plan cross-sectional assembly view of the switch device of a socket wrench extension as shown in FIG. 1.
Figure 4:
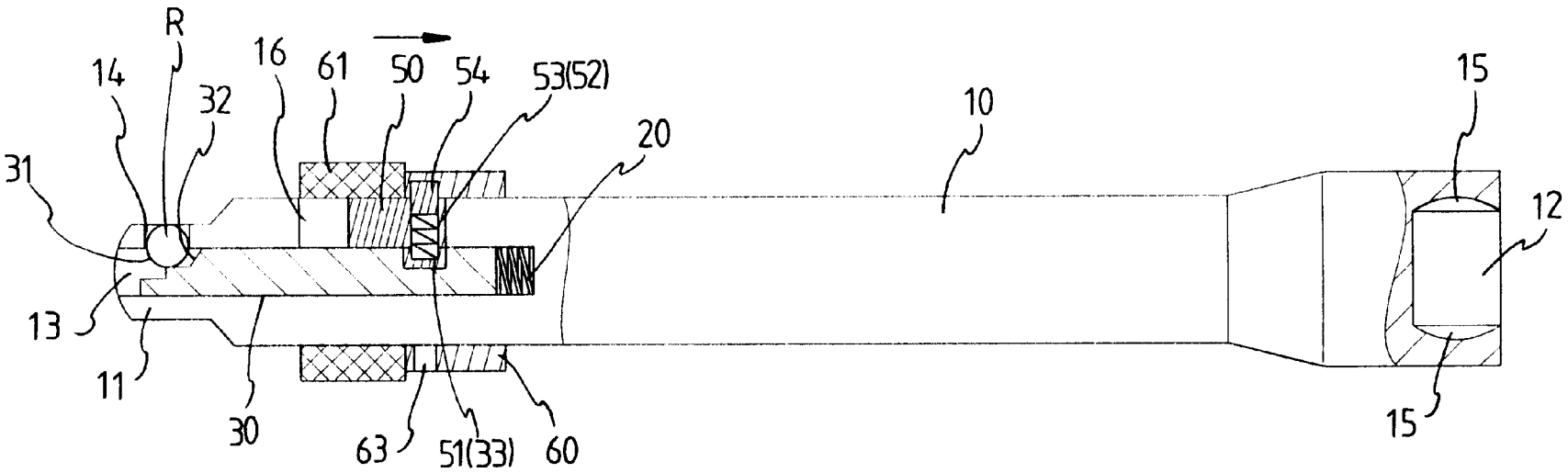
FIG. 4 is a schematic operational view of the switch device of a socket wrench extension as shown in FIG. 2 in use.

Referring to the drawings and initially to FIGS. 1–4, a switch device of a socket wrench extension in accordance with a first embodiment of the present invention comprises a connecting shank 10 having a front end formed with a square fitting head 11 and a rear end formed with a square fitting hole 12. The center of end face of the square fitting head 11 is formed with an axial circular hole 13 having a proper depth. The axial circular hole 13 receives a restoring member 20 and a drive rod 30 therein. A radial hole 14 is defined through the surface of the square fitting head 11, and is communicated with the axial circular hole 13. A positioning ball "R" is received in the radial hole 14. The front end of the drive rod 30 is formed with a step 31 which is formed with a tapered face 32. When the drive rod 30 is pressed by the restoring member 20, the positioning ball "R" is pressed along the tapered face 32 to expose outward from the radial hole 14, so that the positioning ball "R" may engage the socket 40 or another connecting shank 10. The wall faces of the square fitting holes 41 and 12 of the socket 40 and the connecting shank 10 are respectively formed with positioning recesses 42 and 15, thereby forming a snap fixing relationship with the positioning ball "R".

The mediate portion of the drive rod 30 is formed with an insertion recess 33. A radial oblong slot 16 that aligns with the insertion recess 33 is defined in the connecting shank 10 and is communicated with the axial circular hole 13. A drive block 50 is received in the radial oblong slot 16, and has a bottom protruded with an insertion block 51 that may be inserted into the insertion recess 33 of the drive rod 30. The drive block 50 has a top defining a spring recess 52 for receiving a spring 53 and a positioning pin 54. A control ring 60 is mounted on the connecting shank 10, and a knurl face 61 is formed on the surface of the control ring 60 for facilitating movement of the control ring 60. The inner wall of the control ring 60 is formed with a groove 62, so that when the control ring 60 is mounted on the connecting shank 10, the control ring 60 may be secured on the positioning pin 54 integrally. A through hole 63 is defined in the groove 62, and has a diameter slightly smaller than that of the positioning pin 54. Thus, during the dismantling process, the through hole 63 may register the positioning pin 54, and a sharp object may then be inserted into the positioning pin 54, to detach the positioning pin 54 from the groove 62 of the control ring 60, thereby removing the control ring 60.

In operation, the drive rod 30 is subjected to the restoring action of the restoring member 20, to push and press the positioning ball "R" to expose outward from the radial hole 14, so that the positioning ball "R" is secured with the positioning recess 42 of the square fitting hole 41 of the socket 40.

The user only needs to use his one hand to directly force the control ring 60 to move backward, to synchronously drive the drive block 50 to move backward, while the drive rod 30 is moved backward synchronously, so that the positioning ball "R" may be moved along the tapered face 32 of the drive rod 30 to sink into the radial hole 14, thereby detaching the positioning ball "R" from the socket 40, so that the connecting shank 10 can be drawn outward from the socket 40 easily and quickly.

Similarly, the user may also use the control ring 60 to move the drive rod 30, so that the positioning ball "R" may be initially sunk into the radial hole 14, thereby facilitating the square fitting head 11 of the connecting shank 10 being inserted into the socket 40, so that the operation is very convenient.

Figure 5:
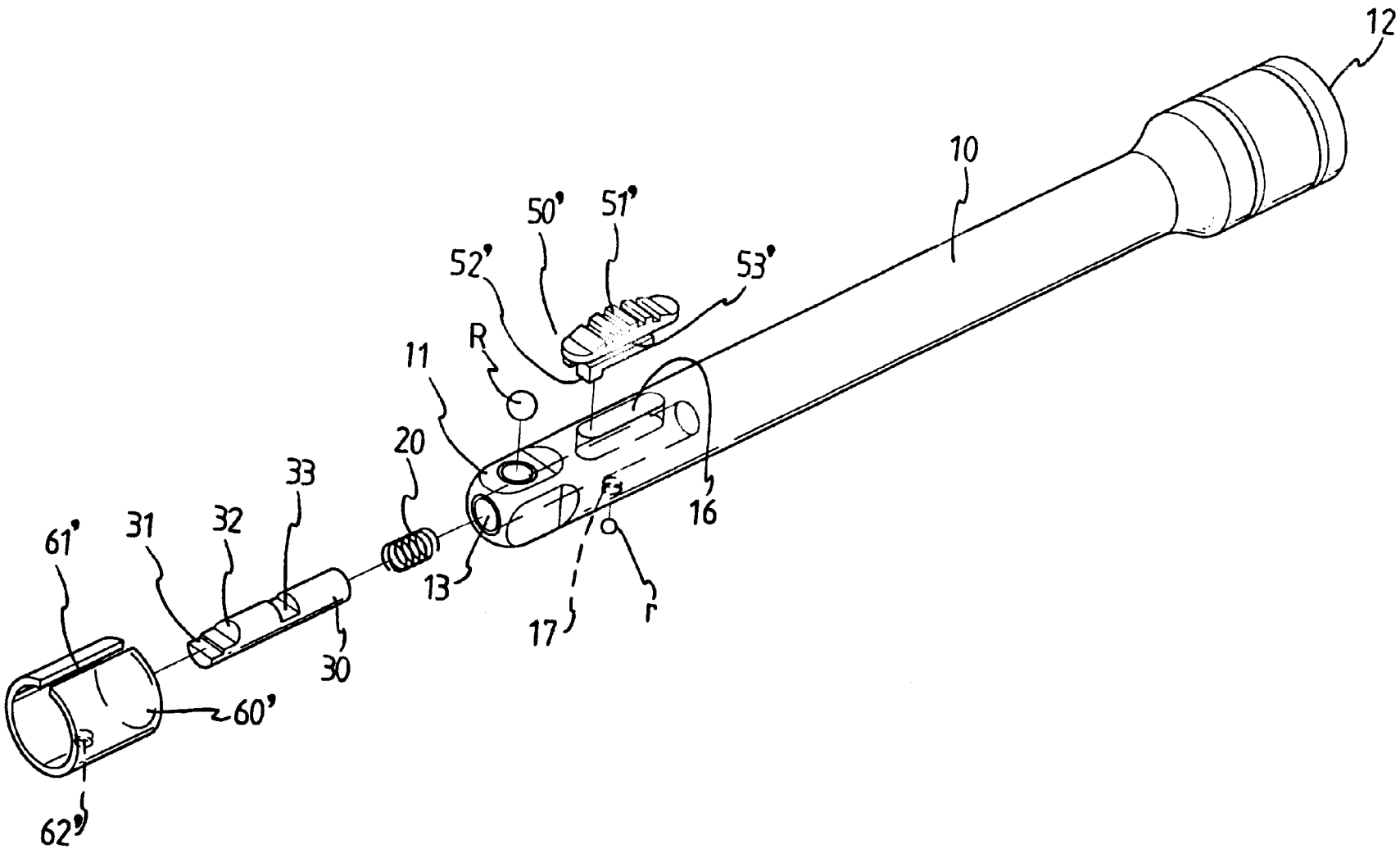
FIG. 5 is an exploded perspective view of a switch device of a socket wrench extension in accordance with a second embodiment of the present invention.
Figure 5A:
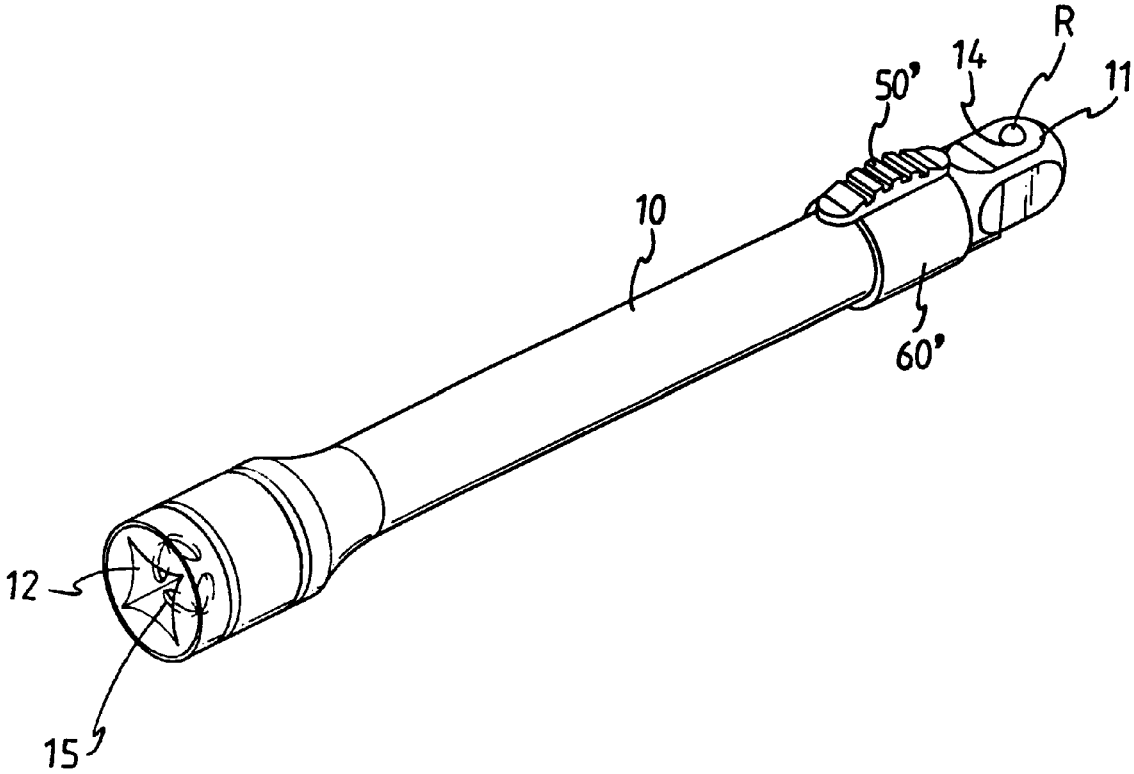
FIG. 5A is a perspective view of the switch device of the socket wrench extension in accordance with the second embodiment of the present invention.
Figure 5B:
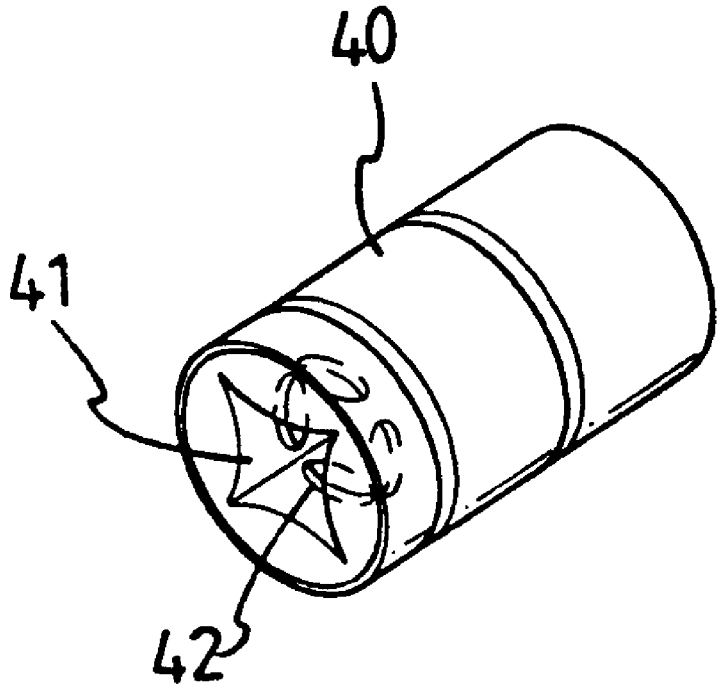
FIG. 5B is a perspective view of a socket usable with the socket wrench extension in accordance with the second embodiment of the present invention.
Figure 6:
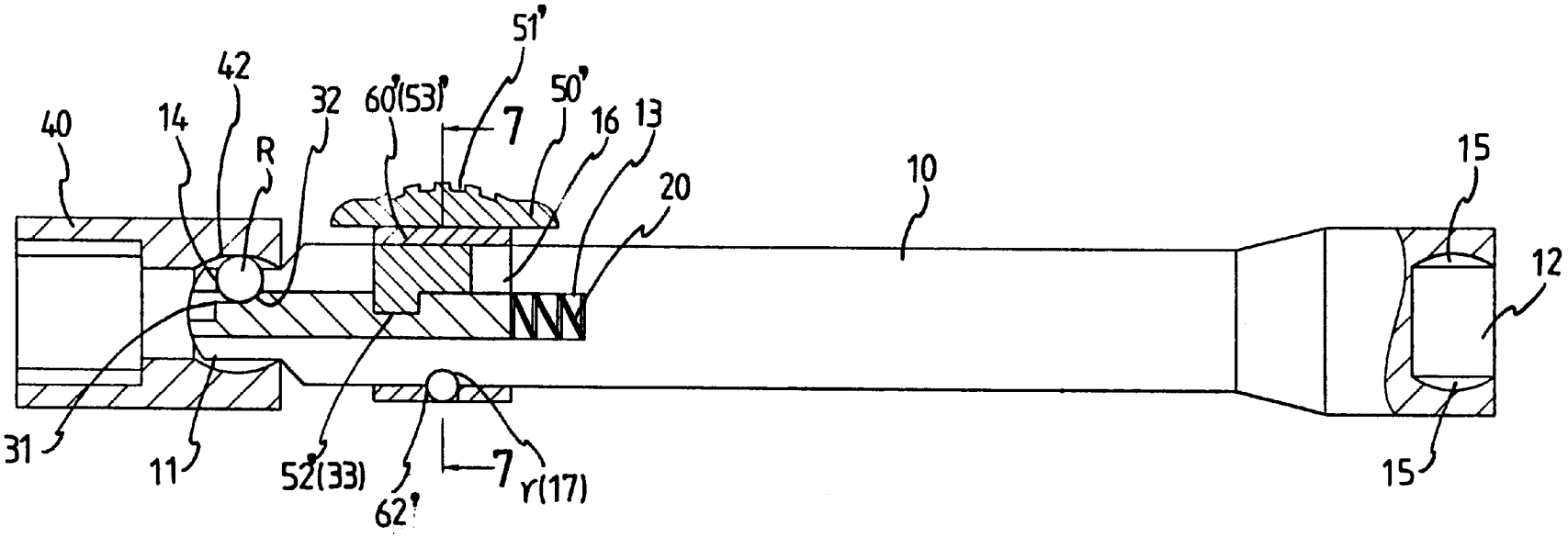
FIG. 6 is a front plan cross-sectional assembly view of the switch device of a socket wrench extension as shown in FIG. 5.
Figure 7:
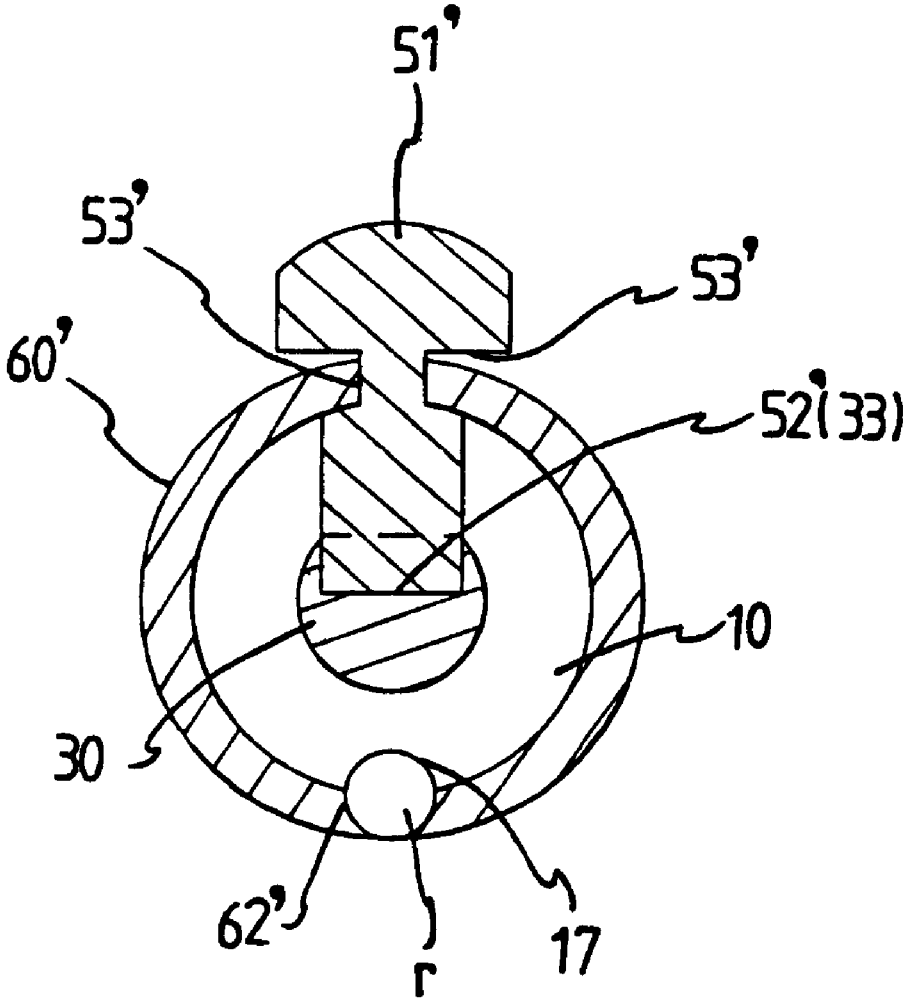
FIG. 7 is a side plan cross-sectional assembly view of the switch device of a socket wrench extension as shown in FIG. 5.
Figure 8:
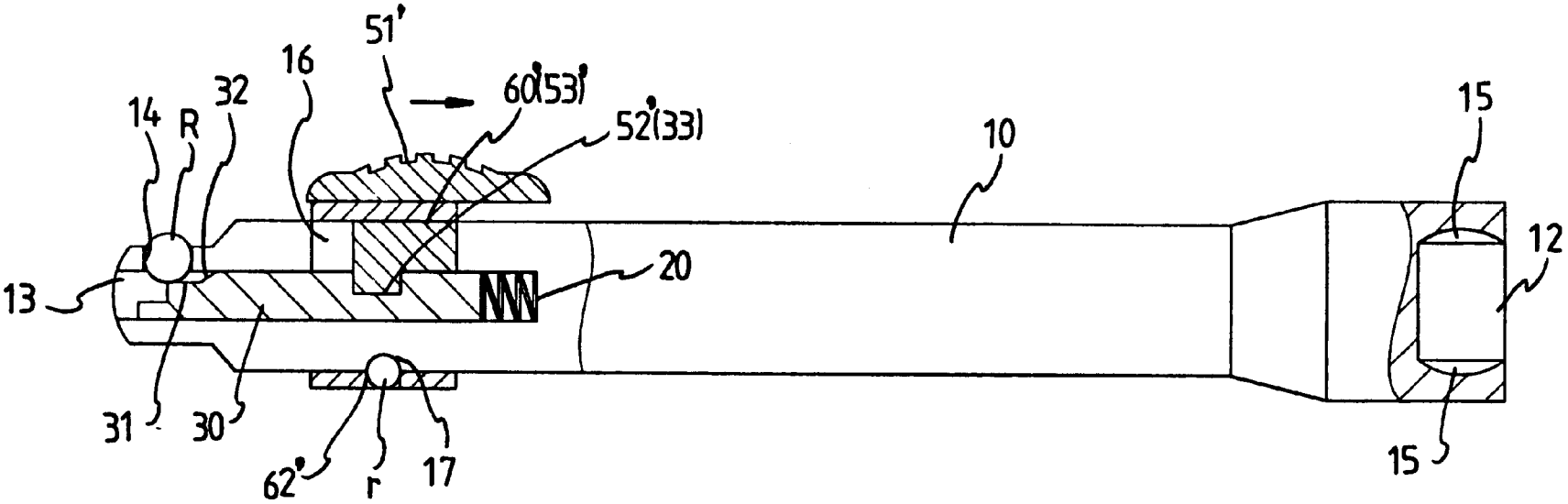
FIG. 8 is a schematic operational view of the switch device of a socket wrench extension as shown in FIG. 6 in use.

Referring to FIGS. 5–8, a switch device of a socket wrench extension in accordance with a second embodiment of the present invention comprises a connecting shank 11 having a front end formed with a square fitting head 11 and a rear end formed with a square fitting hole 12. The center of end face of the square fitting head 11 is formed with an axial circular hole 13 having a proper depth. The axial circular hole 13 receives a restoring member 20 and a drive rod 30 therein. A radial hole 14 is defined through the surface of the square fitting head 11, and is communicated with the axial circular hole 13. A positioning ball "R" is received in the radial hole 14. The front end of the drive rod 30 is formed with a step 31 which is formed with a tapered face 32. When the drive rod 30 is pressed by the restoring member 20, the positioning ball "R" is pressed along the tapered face 32 to expose outward from the radial hole 14, so that the positioning ball "R" may engage with the socket 40 or another connecting shank 10. The wall faces of the square fitting holes 41 and 12 of the socket 40 and the connecting shank 10 are formed with positioning recesses 42 and 15 respectively, thereby capable of forming a snap fixing relationship with the positioning ball "R".

The mediate portion of the drive rod 30 is formed with an insertion recess 33. A radial oblong slot 16 that aligns with the insertion recess 33 is defined in the connecting shank 10 and is communicated with the axial circular hole 13. A drive knob 50' is received in the radial oblong slot 16, and has a surface formed with an emboss 51' for facilitating movement of the drive knob 50'. The bottom of the drive knob 50' is protruded with an insertion block 52' that may be inserted into the insertion recess 33 of the drive rod 30 for pushing the drive rod 30. The mediate portion of the drive knob 50' has two sides each defining a snap groove 53' for securing a snap ring 60'whose periphery is formed with a slit 61' which is secured with the snap grooves 53' at the two sides of the drive knob 50'. A positioning hole 62' is defined in the periphery of the snap ring 60' and is radially opposite to the slit 61'. A ball recess 17 that aligns with the positioning hole 62' is defined in the periphery of the connecting shank 10, for receiving a ball "r" which is secured between the positioning hole 62' and the ball recess 17, such that the snap ring 60' is secured on the connecting shank 10.

In operation, the drive rod 30 is subjected to the restoring action of the restoring member 20, to push and press the positioning ball "R" to expose outward from the radial hole 14, so that the positioning ball "R" is secured with the positioning recess 42 of the square fitting hole 41 of the socket 40. The user only needs to use his one hand to directly force the drive knob 50' to move backward, to synchronously drive the drive rod 30 to move backward, so that the positioning ball "R" may be moved along the tapered face 32 of the drive rod 30 to sink into the radial hole 14, thereby detaching the positioning ball "R" from the socket 40, so that the connecting shank 10 can be drawn outward from the socket 40 easily and quickly.

Similarly, the user may also use the drive knob 50' to move the drive rod 30, so that the positioning ball "R" may be initially sunk into the radial hole 14, thereby facilitating the square fitting head 11 of the connecting shank 10 being inserted into the socket 40, so that the operation is very convenient.

While the preferred embodiment of the present invention has been shown and described, it will be apparent to those skilled in the art that various modifications may be made in the embodiment without departing from the spirit of the present invention. Such modifications are all within the scope of the present invention.

What is claimed is:

1. A switch device of a socket wrench extension, comprising:

a connecting shank having a square fitting head whose front end is formed with an axial circular hole for receiving a restoring member and a drive rod therein, a radial hole defined through a surface of the square fitting head for receiving a positioning ball, a front end of the drive rod formed with a step having a tapered face, so that the positioning ball is pushed along the tapered face to expose outward from the radial hole;

wherein, a mediate portion of the drive rod is formed with an insertion recess, a radial oblong slot that aligns with the insertion recess is defined in the connecting shank and is communicated with the axial circular hole, a drive block is received in the radial oblong slot, and has a bottom protruded with an insertion block that may be inserted into the insertion recess of the drive rod, the drive block has a top defining a spring recess for receiving a spring and a positioning pin, a control ring is mounted on the connecting shank, an inner wall of the control ring is formed with a groove, so that when the control ring is mounted on the connecting shank, the control ring may be secured on the positioning pin integrally, a through hole is defined in the groove, and has a diameter slightly smaller than that of the positioning pin, so that the through hole may register the positioning pin during a dismantling process.

2. A switch device of a socket wrench extension, comprising:

a connecting shank having a square fitting head whose front end is formed with an axial circular hole for receiving a restoring member and a drive rod therein, a radial hole defined through a surface of the square fitting head for receiving a positioning ball, a front end of the drive rod formed with a step having a tapered face, so that the positioning ball is pushed along the tapered face to expose outward from the radial hole;

wherein, a mediate portion of the drive rod is formed with an insertion recess, a radial oblong slot that aligns with the insertion recess is defined in the connecting shank and is communicated with the axial circular hole, a drive knob is received in the radial oblong slot, and has a bottom protruded with an insertion block that may be inserted into the insertion recess of the drive rod, a mediate portion of the drive knob has two sides each defining a snap groove for securing a snap ring whose periphery is formed with a slit which is secured with the snap grooves at the two sides of the drive knob, a positioning hole is defined in the periphery of the snap ring and is radially opposite to the slit, a ball recess that aligns with the positioning hole is defined in a periphery of the connecting shank, for receiving a ball which is secured between the positioning hole and the ball recess, such that the snap ring is secured on the connecting shank.

* * * * *